United States Patent [19]

Matsui et al.

[11] 4,125,362

[45] Nov. 14, 1978

[54] HEAT ROLLER AND TONER IMAGE FIXING DEVICE MADE THEREWITH

[75] Inventors: Toshio Matsui, Toyokawa; Nobuo Kitou, Hoi, both of Japan

[73] Assignee: Minolta Camera Kabushiki Kaisha, Japan

[21] Appl. No.: 790,874

[22] Filed: Apr. 26, 1977

[30] Foreign Application Priority Data

Apr. 28, 1976 [JP] Japan ..... 5148988

[51] Int. Cl.[2] ..... G03G 13/08; B05C 11/00

[52] U.S. Cl. ..... 432/60; 29/129.5; 29/132; 219/469

[58] Field of Search ..... 29/129.5, 132; 219/469, 219/216; 432/59, 60, 228; 100/93 RP; 118/60, 70, 637

[56] References Cited

U.S. PATENT DOCUMENTS

| | | | |
|---|---|---|---|
| 3,731,358 | 5/1973 | Artl | 432/60 |
| 3,881,859 | 5/1975 | Hamilton | 432/60 |
| 3,902,845 | 9/1975 | Murphy | 432/60 |
| 3,912,901 | 10/1975 | Strella et al. | 219/216 |
| 3,957,423 | 5/1976 | Mueller | 432/60 |
| 3,965,853 | 6/1976 | Moser | 432/60 |
| 4,019,024 | 4/1977 | Namiki | 432/60 |
| 4,065,586 | 12/1977 | Eddy et al. | 432/60 |

*Primary Examiner*—Henry C. Yuen

*Attorney, Agent, or Firm*—Watson, Cole, Grindle & Watson

[57] ABSTRACT

A thermal fixing device which includes a heat roller which is positioned to contact a toner image-bearing surface of a copy sheet in order to completely fix the already preliminarily fixed toner image as the copy sheet moves through the thermal fixing device, the surface of the heat roller being made of RTV silicone rubber which contains 25 to 35% by weight of non-reactive dimethyl silicone oil having a viscosity of 10 to 300 centistoke and a trimethyl siloxy group as an end group. The heat roller contacts the toner image-bearing surface of the copy sheet with a total pressure of about 1.5 to 4.5Kg.

20 Claims, 3 Drawing Figures

HEAT ROLLER AND TONER IMAGE FIXING DEVICE MADE THEREWITH

BACKGROUND OF THE INVENTION

The present invention relates to a device for thermally fixing a toner image on a copy sheet, the copy sheet being first heated to a temperature sufficient to partially fix the toner image, and then the copy sheet being contacted by a heat roller which functions to completely fix the toner image. More particularly, the present invention relates to the particular material which makes up the surface of the heat roller.

In the art, devices are known for thermally fixing of toner images, including devices which employ heat rollers for pressing and heating of copy sheets. Many attempts have been made to improve these types of devices. One of these attempts is represented in Japanese Laid Open Utility Model Publication No. Sho 47-22939 which was published on Nov. 15, 1972. In this device the copy sheet is heated in a preliminary heating step up to a temperature at which the toner image on the copy sheet becomes semi-fixed and thereafter the toner image is completely fixed by means of a heat roller. This device is effective in eliminating the drawbacks of other prior art fixing devices wherein the toner image is fixed by a heat roller alone. In such devices which only utilize a heat roller for toner image fixing, the heating period is quite short, and in order to enhance the efficiency of heat transfer from the heat roller it is necessary to utilize an increased pressing force to the heat roller and to enlarge the nip width so as to increase the amount of heat applied to the toner image. Typically, such pressures required have been as high as 10 to 50 Kg. Such pressures, however, resulted in damage to the heat roller, jamming or sticking of the copy sheet to the heat roller, etc. In contrast to this, the above-noted Japanese Utility Model Application allowed for a reduction in the pressing force required of the heat roller as well as a reduction in the offset of toner image and the jamming or sticking of the copy sheet to the heat roller.

However, the device of the above-noted Japanese Utility Model Application suffers from drawbacks of its own: after the fixing of several thousand copy sheets the material of the heat roller tends to change in quality, thereby resulting in the occurrence of offset of the toner image to the heat roller or the jamming and undesirable sticking of the copy sheets to the heat roller. To deal with this problem, frequent replacement of the heat roller must be resorted to, or else the application of silicone oil to the heat roller is required. Such countermeasures are, however, impractical because the former makes proper maintenance of the copy machine itself difficult and the latter requires the provision of a silicone oil application mechanism, thus resulting in a greater complexity of the construction of the device.

It has been proposed to omit the use of a silicone oil application mechanism and to instead use a heat roller impregnated with silicone oil, e.g., by soaking the heat roller in a bath of silicone oil for a long period of time. However, in situations wherein the toner image on the copy sheet is not subjected to a preliminary fixing, an increase in the amount of silicone oil impregnated in the heat roller will cause the heat roller to deform as a result of the necessarily applied high pressure. Thus, the amount of silicone oil contained in the heat roller is usually less than 20% by weight.

In U.S. Pat. No. 3,731,358 to Artl, it is taught that offset can be prevented when fixing toner images on copy sheets when the heat roller contains a silicone rubber outer layer. Furthermore, it is taught to impregnate the roller with a silicone oil to help avoid offset. However, no mention is made of any specific amounts of impregnated silicone oil, i.e., the amounts which would be necessary to prevent jamming or undesirable sticking of the copy sheet around the heat roller.

It is an object of the present invention to provide a heat roller for a thermal fixing device wherein excellent fixing of toner images on copy sheets can be obtained even after a large number of copy sheets have been subjected to the fixing treatment and wherein offset of the toner image to the surface of the heat roller and jamming or undesirable sticking of the copy sheets to the heat roller can be prevented.

SUMMARY OF THE INVENTION

According to the present invention the heat roller is improved in characteristics when it is made of an RTV silicone rubber which contains 25 to 35% by weight of a non-reactive dimethyl silicone oil having a trimethyl siloxy group as an end group. Such a heat roller, when used in a fixing device which utilizes a preliminary fixing means for thermally semi-fixing of the toner image on the copy sheets before being contacted and completely fixed by the heat roller, provides for a much-improved thermal fixing device.

Further features of the invention will be apparent in the arrangement and construction of the constituent parts in detail as set forth in the following specification taken together with the accompanying drawings.

DESCRIPTION OF THE PREFERRED EMBODIMENTS

Figure 1:
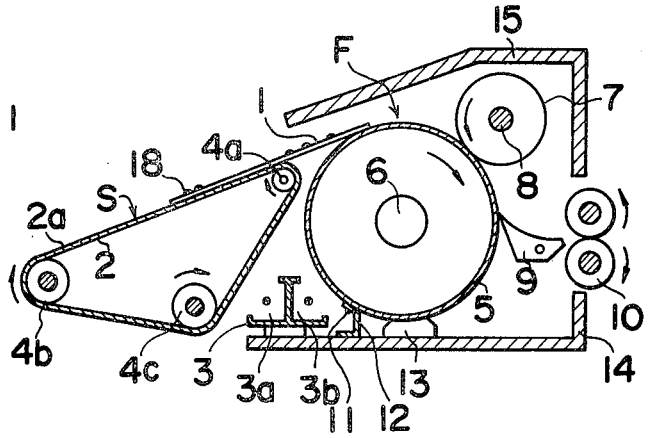
FIG. 1 shows a cross-sectional side elevational view of a device for thermally fixing a toner image which embodies the present invention; and, FIGS. 2 and 3 show cross-sectional side views of further fixing devices which embody the present invention.

Referring to FIG. 1, a copy sheet 1 which has an unfixed toner image 18 on one surface thereof (placed thereon in a developing station, not shown) is transported to a fixing station F by means of a copy sheet transporting belt 2. The copy sheet transporting belt is trained around diametrically small drive roller **4*a* and driven rollers 4*b* and 4*c*, drive roller 4*a* being driven (by a means, not shown) to rotate in a direction (shown by the arrow in FIG. 1) to move belt 2 in order to transport sheet 1 into station F. The belt itself has thereon a high-resistance layer made of Teflon (trademark), and it can be uniformly charged with static electricity by means of corona charger 3*a*, which is integrally formed with corona charger 3*b*, so as to electrostatically attract copy sheet 1** thereto for transport.

As can be seen from FIG. 1, drive roller **4*a* is positioned sufficiently close to heating and transporting drum 5, and drive roller 4*b* is appropriately located such that surface S of the belt 2 is oriented in tangential fashion to the surface of the heating and transporting drum 5. In this way, the copy sheet 1 can be positioned accurately onto the surface of drum 5 when delivered from belt 2**.

It should be noted that other means besides corona charger 3*a* can be used to attract sheet 1 to belt 2, for example, a vacuum suction means could be alternatively employed.

The drum 5 is rotatable such that is can transport copy sheet 1 which has been delivered to the surface thereof, and at the same time it can heat the sheet from the back surface thereof (surface opposite the surface on which the unfixed toner is located). The drum includes a heat conductive outer cylindrical wall made of aluminum or the like which has a heat resistant, high resistance layer on the outer peripheral surface thereof, this layer comprising, for example, Teflon (trademark). This layer is uniformly charged with static electricity by means of corona charger 3*b*. The drum 5 has positioned therein a quartz ray lamp 6 which has a rod shape and which produces infrared rays in order to heat the outer drum wall. The drum is rotated in the same direction as the belt, and in synchronism with the movement of the copy sheet transporting belt 2, by means (not shown). In order to shorten the warm-up period for the fixing device during start-up of the copy machine in which the fixing device is located, it is preferable that the drum 5 be sealingly covered with a heat insulating material on the opposite sides thereof and that the inner peripheral surface of the outer wall be subjected to a heat-absorbing treatment. For example, when the drum 5 has an outer cylindrical wall of aluminum, it is advantageous to coat the inner surface thereof with a black substance.

It should be noted that the infrared ray lamp 6 which is shown as the heat source in FIG. 1 can be replaced with a flat surface-type heater which can be positioned along the inner surface of the outer cylindrical wall. Indeed, the infrared ray lamp 6 may be disposed outside of the drum 5 sufficiently far that direct heating of the copy sheet 1 is avoided but close enough that radiation can heat the heat insulating layer on the outer wall of the drum.

A heat roller 7 which is rotated by shaft 8 in synchronism with the rotation of heating and transporting drum 5 is positioned so as to maintain surface contact with the surface of drum 5. This is achieved by a combination of the weight of roller 7 (about 1 Kg) and the use of an auxiliary pressing force (via means, not shown) of about 0.5 to 3.5 Kg, preferably about 0.9 Kg. Heat roller 7 is generally positioned in contact with drum 5 such that in operation about 0.6 second will pass between the time the leading end of copy sheet 1 contacts drum 5 and then passes through the nip between drum 5 and 7. The optimum position of heat roller 7 is determined in fact according to the properties of the toner which is being used, the surface temperature of the heating and transporting drum 5, and the copying speed. This assures that the viscosity of the fused toner can be controlled such that offset of the fused toner onto the heat roller when the copy sheet passes by can be prevented.

During the periods when no copy sheet is passing between drum 5 and roller 7, roller 7 is warmed by heat transmitted from drum 5; however, since roller 7 must not be ever heated sufficiently that an offset of the toner will occur on the surface thereof, a cooling means can be employed (not shown) to reduce the surface temperature of roller 7.

The surface of heat roller 7 is composed of RTV silicone rubber containing about 25 to 35% by weight of non-reactive dimethyl silicone oil. The silicone oil is one which has a trimethyl siloxy group as an end group. This type of roller surface is both non-adhesive to toners, as well as heat insulating in characteristic.

A metallic separating pawl 9 is utilized for separating copy sheet 1 from the surface of drum 5, the pawl having a tip in contact with the peripheral surface of the drum and shaped to guide sheet 1 towards delivery roller 10. A temperature-detecting thermister 11 which is supported by a holder 12 is maintained in contact with the peripheral surface of the outer wall of drum 5 and is appropriately connected by circuits (not shown) to control the operation of the infrared ray lamp 6 and thereby function to control the surface temperature of the drum continuously. A cleaning pad 13, which may be of felt, is placed adjacent the lower peripheral surface of the drum 5 to wipe off any toner which may have stuck to the surface of the drum from the back surfaces of the copy sheet.

Corona chargers 3*a*, 3*b*, holder 12 and clearing pad 13 are all attached to a bottom support plate 14. In the upper portion of fixing station F a heat-retaining cover 15 which is made of a heat-insulating material is provided in order to completely cover the drum 5 and the roller 7 and thereby improve the heating efficiency of the fixing device.

In order to further shorten the warm-up period for the fixing device, a separate heating means (not shown) can be provided for heating heat roller 7, this heating means being arranged to be energized during the warm-up period, i.e., during the initial operation of the copy machine.

Further, to help achieve an enhanced separation of the copy sheet 1 from the drum surface, the drum surface may have a narrow annular groove therein (i.e., around the peripheral outer surface of the cylindrical wall) and the peeling pawl 9 may have an elongated tip portion which fits within the groove.

In operation, a copy sheet 1 which has an unfixed toner image 18 on one surface thereof (for example, using a toner composed of a monocomponent epoxy resin having a melting point of between 75° to 85° C. as disclosed in U.S. Pat. No. 3,639,245, i.e., in Example E of Table I therein) is transported by the copy sheet transporting belt 2 (while being electrostatically attracted thereto), and then by virtue of its stiffness and toughness the copy sheet is transferred to the surface of drum 5, i.e., by separation from the surface S of the belt 2 at the diametrically small drive roller 4*a*. The copy sheet is electrostatically attracted to the surface of drum 5, and during its transport thereon the copy sheet undergoes a heating from the back thereof in order to partially fix the toner image such that the toner image will no longer be spoiled by a soft mechanical contact therewith. Copy sheet 1 is then passed between drum 5 and heat roller 7 and at this point the toner image becomes completely fixed by the heat transmitted from heat roller 7, while at the same time the image surface is flattened by the pressure within the nip between the drum and roller. Thus, even if the toner image should still retain a weak sticking property due to non-uniform contact between the back surface of the copy sheet and the surface of the heating drum 5, by passage through the nip between drum 5 and roller 7 the toner image becomes uniformly stuck to the copy sheet by the combination of heating and pressing provided by roller 7.

Due to the fact that the surface of roller 7 is formed from RTV silicone rubber containing about 25 to 35% by weight of non-reactive dimethyl silicone oil having a trimethyl siloxy group as an end group, the intended performance of roller 7 is maintained over a long period of time and offset of the toner image and/or sticking of the copy sheet to the roller 7 is avoided, even after a large number of copy sheets have been subjected to a fixing treatment.

The copy sheet which passes through the nip between drum 5 and roller 7, and which has the toner image fixed on the surface is separated from the drum 5 by means of the separating pawl 9 and is then delivered by way of delivery roller 10 to the outside of the copy machine.

Figure 2:
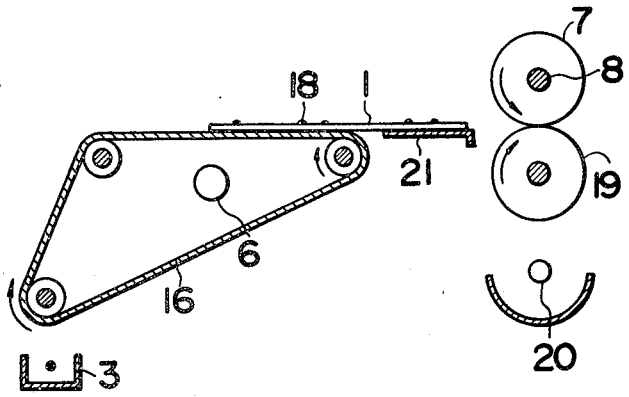

In FIG. 2 the heating and transporting drum 5 of FIG. 1 is replaced with an endless belt 16 supported by suitable rolls, and a copy heat guide 21 conveys the copy sheet between the nip formed between a heat roller 7 and a support roller 19, use being made of an infrared ray lamp 20.

Figure 3:
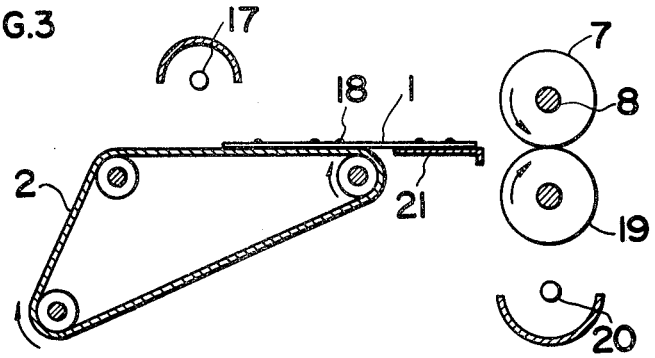

In FIG. 3 the infrared ray lamp 6 and corona discharger 3 (as shown in FIG. 2) are omitted and an infrared ray lamp 17 is provided for directly irradiating the copy sheet 1 to heat the toner image. In this embodiment the transporting belt 2 is intended to function to transport the copy sheet only.

Regarding the FIG. 1 embodiment of the invention, it has been found that when the toner employed is composed of a monocomponent epoxy resin having a fusing point of 72° C. (such as the product under the trade name of 3M-355 made by the 3M Company) (measured by a Shimazu differential thermal analysis device), it is best to maintain the surface temperature of the drum 5 at about 130° C. and the surface temperature of heat roller 7 at above about 80° C., but no higher than 125° C.

The silicone oil which is utilized in the RTV silicone rubber which is used as the surface material for the heat roller 7 acts to prevent offset, and in fact this oil exudes little-by-little from the interior of the RTV silicone rubber roller to both prevent offset of the toner image and jamming or undesirable sticking of the copy sheets to the roller upon fixing of the toner image. Indeed, increased amounts of silicone oil in RTV silicone rubber provides improved physical properties to the silicone rubber as shown by various tests conducted by the inventors. These tests follow.

EXAMPLE 1

Various RTV silicone rubber samples containing respectively 20, 25, 30, 35 and 40% by weight of non-reactive dimethyl silicone oil (KF 96, a tradenamed product of Shinetsu Kagaku Kogyo Kabushiki Kaisha) having a trimethyl siloxy group as an end group were prepared. This was accomplished by adding, respectively, 25, 33, 43, 54 and 67 parts by weight of silicone oil to 100 parts by weight of a mixture containing reactive dimethyl silicone oil having a hydroxyl group as an end group (base oil) and fillers using fumed silica (reinforcing filler) and diatomaceous earths and ground quartz (extending fillers) (mixture ratio 2:1), respectively, and after hardening there was obtained RTV silicone rubber samples having the desired silicone oil contents. These samples were then tested regarding their physical properties, and the following results were obtained.

Table 1

| Content of silicone oil (% by weight) | Hardness | Tensile Strength ($kg/cm^2$) |
|---|---|---|
| 20 | 43 | 23 |

Table 1-continued

| Content of silicone oil (% by weight) | Hardness | Tensile Strength ($kg/cm^2$) |
|---|---|---|
| 25 | 39 | 22 |
| 30 | 35 | 21 |
| 35 | 31 | 16 |
| 40 | 26 | 12 |

It can be seen from the results in Table 1 that the larger the amount of silicone oil contained in the silicone rubber, the lower the physical strength thereof.

EXAMPLE 2

Heat rollers were made from the various RTV silicone rubbers prepared in Example 1 and these rollers were used for effecting complete fixing of a toner image on a copy sheet, the toner image having been subjected to a preliminary fixing step, i.e., the toner image had been fused with heat to some extent and the adhesion of the toner to the copy sheet had progressed to a substantial extent. During the fixing, the heat roller pressed against the copy sheet with varying forces, these forces consisting of the summation of a force produced by the weight of the heat roller itself (about 1.0 Kg) and an applied external force (in the range of 0 to 5 Kg).

When the applied pressing force was higher than 3.5 Kg, wrinkles or creases were found in the copy sheet, or else a defective contact between the central area of the copy sheet and the copy sheet supporting roller took place.

In sum, Examples 1 and 2 are believed to support the idea that since the formation of wrinkles or creases in a copy sheet or the defective contact between the copy sheet in its central area and the support roller is attributable to the deformation of heat roller itself, this can be caused by the deteriorated physical properties of the silicone rubber surface thereof (see results of Example 1), and in order to prevent the formation of wrinkles or creases in the copy sheet, as well as to provide improved fixing characteristics, a force pressing the heat roller against the support roller between about 0.5 and 3.5 Kg is desirable, and most preferably falls within the range of 0.8 to 1.0 Kg.

EXAMPLE 3

The heat rollers made from the RTV silicone rubbers prepared in Example 1 were used to fix a toner image on a copy sheet in a similar fashion to the process in Example 2, the pressing surface applied to the rollers being 0.88 Kg. The rollers had a diameter of 36 mm, a length of 11 inches, and were operated to have a surface speed of 10 cm/sec. Twenty thousand copy sheets were subjected to a fixing treatment and after each the system examined for the occurrence of offset phenomenon and the occurrence of jamming or undesired sticking of the copy sheets to the heat roller. The results given in Table 2 were obtained.

Table 2

| Amount of silicone oil in the RTV silicone rubber of heat roller (% by weight) | Number of sheets before offset phenomenon observed | Number of sheets before sheet-sticking phenomenon observed |
|---|---|---|
| 20 | 5,000 — 10,000 | no less than 20,000 |
| 25 | no less than 20,000 | no less than 20,000 |
| 30 | no less than 20,000 | no less than 20,000 |
| 35 | no less than 20,000 | no less than 20,000 |

Table 2-continued

| Amount of silicone oil in the RTV silicone rubber of heat roller (% by weight) | Number of sheets before offset phenomenon observed | Number of sheets before sheet-sticking phenomenon observed |
|---|---|---|
| 40 | no less than 20,000 | 7,000 |

From the results shown in Table 2, it can be seen that with a heat roller utilizing an RTV silicone rubber surface which contains 20% by weight of silicone oil, offset phenomenon began to be observed after 5,000 to 10,000 copy sheets had been subjected to a fixing treatment. It is believed that the reason that offset was observed after 5,000 to 10,000 copy sheets had been fixed with this particular heat roller is due to the possibility that the quality of the RTV silicone rubber became changed after such long service, resulting in a need for a narrower temperature range for the surface thereof to achieve fixing of the toner image without causing offset. In other words, it is believed that if the temperature of the surface of the heat roller could have been maintained absolutely constant, the noted offset would not have occurred. However, in practice such temperature uniformity is difficult to maintain within the required tolerance of 2° to 3° C. It is also believed that the specific numbers of copy sheets which were fixed prior to the observance of offset, i.e., the noted 5,000 to 10,000 copy sheets, would be subject to variance depending on the type of toner used, the specific fixing temperature required, etc.

It can also be seen from the results shown in Table 2 that with a heat roller utilizing an RTV silicone rubber surface which contains 40% by weight of silicone oil, sheet sticking phenomenon began to be observed after 7,000 copy sheets had been subjected to a fixing treatment. It is believed that the reason that sheet sticking was observed after 7,000 copy sheets had been fixed with this particular heat roller is due to the possibility that the RTV silicone rubber is not high enough in physical strength to be durable over a long service time, and hence is subject to deformation during its service.

The experimental results above shown prove that in a device for thermally fixing a toner image wherein a copy sheet is first heated in a preliminary heating step to a temperature at which a toner image thereon is partly fixed and then the toner image is completely fixed by means of a heat roller, if the RTV silicone rubber of the heat roller contains between about 25 to 35% by weight of a non-reactive dimethyl silicone oil having a trimethyl siloxy group as an end group, enhanced results in terms of the avoidance of offset and copy sheet sticking can be achieved, even after a large number of copy sheets have been subjected to the fixing treatment.

With respect to the foregoing Examples, it should be noted that the silicone oil used had a viscosity of 100 centistoke. However, silicone oil having a viscosity of between about 10 to 300 centistokes produced the same results as shown in Examples 1–3. On the other hand, if the viscosity of the silicone oil was too low, the oil tended to volatilize from the heat roller when heated; if the viscosity of the silicone oil was too high, the oil tended to ooze out of the roller and become eventually offset thereon. A viscosity of about 20 to 200 centistokes was found to be most preferable according to the present invention from the standpoint of physical properties of the heat roller.

We claim:

1. In a toner image-fixing device which includes a preliminary means for thermally treating a toner image on a surface of a copy sheet to transform it into a semi-fixed state and a heat roller which contacts the surface of the copy sheet on which the semi-fixed toner image is located in order to completely fix the toner image, the improvement wherein the heat roller which contacts the semi-fixed toner image is made of RTV silicone rubber containing 25 to 35% by weight of chemically combined silicone oil such that thermal fixing of the toner image can be achieved without causing offset of the toner image onto the surface of the heat roller and without jamming or undesirable sticking of the copy material to the surface of the heat roller.

2. A toner image-fixing device as in claim 1, wherein said silicone oil consists of a non-reactive dimethyl silicone oil having a trimethyl siloxy group as an end group.

3. A toner image-fixing device as in claim 2, wherein said silicone oil has a viscosity of between 10 to 300 centistoke.

4. A toner image-fixing device as in claim 3, wherein said viscosity is between about 20 to 200 centistoke.

5. A toner image-fixing device as in claim 2, wherein said heat roller is fabricated from a composition which consists of 33 to 54 parts by weight of said silicone oil and 100 parts by weight of a mixture containing reactive dimethyl silicone oil having a hydroxyl group as an end group and fillers, the ratio of said reactive dimethyl silicone oil to said fillers being 2:1.

6. A toner image-fixing device as in claim 1, wherein said heat roller is 11 inches in length and wherein means are provided for pressuring said heat roller against the toner image-bearing surface of said copy sheet such that a total pressure of about 1.5 to 4.5 Kg is achieved per lineal 11 inches.

7. A toner image-fixing device as in claim 1, wherein said preliminary means for thermally treating a toner image on a surface of a copy sheet includes an endless conveyor means upon which the copy sheet is supported, and a means for heating said endless conveyor means sufficiently to cause the toner on the side of the copy sheet opposite the conveyor means to become semi-fixed.

8. A toner image-fixing device as in claim 7, wherein said endless conveyor is a rotatable hollow drum having an outer wall.

9. A toner image-fixing device as in claim 8, wherein said means for heating said endless conveyor is positioned at the center of said hollow drum and is capable of heating the outer wall of said hollow drum.

10. A toner image-fixing device as in claim 9, wherein a means for detecting the temperature of said outer wall of said hollow drum is positioned adjacent thereto.

11. A toner image-fixing device as in claim 10, wherein a corona charger means is positioned adjacent to said outer wall of said hollow drum so as to electrostatically charge said outer wall and thereby electrostatically attract a copy sheet thereto.

12. A toner image-fixing device as in claim 11, wherein said outer wall of said hollow drum includes a heat-conductive cylindrical wall covered by an outer heat-resistant material layer.

13. A toner image-fixing device as in claim 12, wherein said heat-conductive cylindrical wall is formed of aluminum and said heat-resistant material layer is formed of polytetrafluoroethylene.

14. A toner image-fixing device as in claim 11, wherein said heat roller is positioned to contact the semi-fixed toner image on the copy sheet while the copy sheet is supported by the outer wall of said hollow drum.

15. A toner image-fixing device as in claim 14, wherein said heat roller is mounted so as to apply a pressing force of between 1.5 and 4.5 Kg per lineal 11 inches.

16. A toner image-fixing device as in claim 11, wherein means are provided for removing the copy sheet from the outer wall of said hollow drum after being contacted by said heat roller.

17. A toner image-fixing device as in claim 7, wherein said endless conveyor is a flexible endless belt, and wherein said belt is supported by multiple roller means.

18. A toner image-fixing device as in claim 17, wherein said means for heating said endless conveyor is positioned within the path of movement of said flexible endless belt.

19. A toner image-fixing device as in claim 17, wherein said means for heating said endless conveyor is positioned outside the path of movement of said flexible endless belt.

20. A toner image-fixing device as in claim 17, wherein a guide means is positioned adjacent said endless conveyor to support the copy sheet as it leaves the flexible endless belt, and wherein said heat roller is one roller of a pair of rollers forming a nip therebetween, and wherein the copy sheet passes through the nip between said pair of rollers as it leaves said guide means.

* * * * *